US010024145B1

(12) United States Patent
Schmidt et al.

(10) Patent No.: US 10,024,145 B1
(45) Date of Patent: Jul. 17, 2018

(54) METHOD OF CREATING AND FINISHING PERFORATIONS IN A HYDROCARBON WELL

(71) Applicant: The GasGun, Inc., Clackamas, OR (US)

(72) Inventors: Adam C. Schmidt, Happy Valley, OR (US); Jaia D. Schmidt, Happy Valley, OR (US); Richard A. Schmidt, West Linn, OR (US)

(73) Assignee: THE GASGUN, INC., Clackamas, OR (US)

( * ) Notice: Subject to any disclaimer, the term of this patent is extended or adjusted under 35 U.S.C. 154(b) by 610 days.

(21) Appl. No.: 14/585,956

(22) Filed: Dec. 30, 2014

(51) Int. Cl.
*E21B 43/117* (2006.01)
*E21B 43/118* (2006.01)

(52) U.S. Cl.
CPC ..... *E21B 43/117* (2013.01); *E21B 43/118* (2013.01)

(58) Field of Classification Search
CPC ..... E21B 43/117; E21B 43/118
See application file for complete search history.

(56) References Cited

U.S. PATENT DOCUMENTS 4,386,569 A * 6/1983 Deas ..... C06B 45/00 102/285
4,491,185 A 1/1985 McClure
5,690,171 A 11/1997 Winch et al.
6,354,219 B1 3/2002 Pratt et al.
6,991,044 B2 1/2006 Zhange et al.
7,228,907 B2 1/2007 Schmidt et al.
7,621,332 B2 11/2009 Haney et al.
7,913,761 B2 3/2011 Pratt et al.
8,033,332 B2 10/2011 Haney et al.
8,336,437 B2 12/2012 Barlow et al.
8,342,094 B2 1/2013 Marya et al.
8,381,652 B2 2/2013 Glenn

* cited by examiner

*Primary Examiner* — Giovanna C. Wright
*Assistant Examiner* — Manuel C Portocarrero
(74) *Attorney, Agent, or Firm* — Timothy E. Siegel Patent Law, PLLC; Timothy E. Siegel

(57) ABSTRACT

A method of creating and finishing perforations in a hydrocarbon well, starting by shooting a high velocity jet of metal particles into the well wall, thereby creating a perforation in the well wall. After this, a gas blast is pushed into the perforation, for a blast time duration, the gas blast creating an increasing pressure at the perforation, until a maximum is reached, the pressure of the gas then undergoing a period of rapid decline to a level of less than 50% of the maximum pressure. The period of rapid decline takes less than one-sixth of the blast time duration. Accordingly, the time pattern of speed and pressure of the gas blast results in a higher maximum pressure at the perforation, resulting in localized fracturing, emanating from the perforation, which permits a greater flow of hydrocarbons into the perforation and from the perforation into the well.

17 Claims, 6 Drawing Sheets

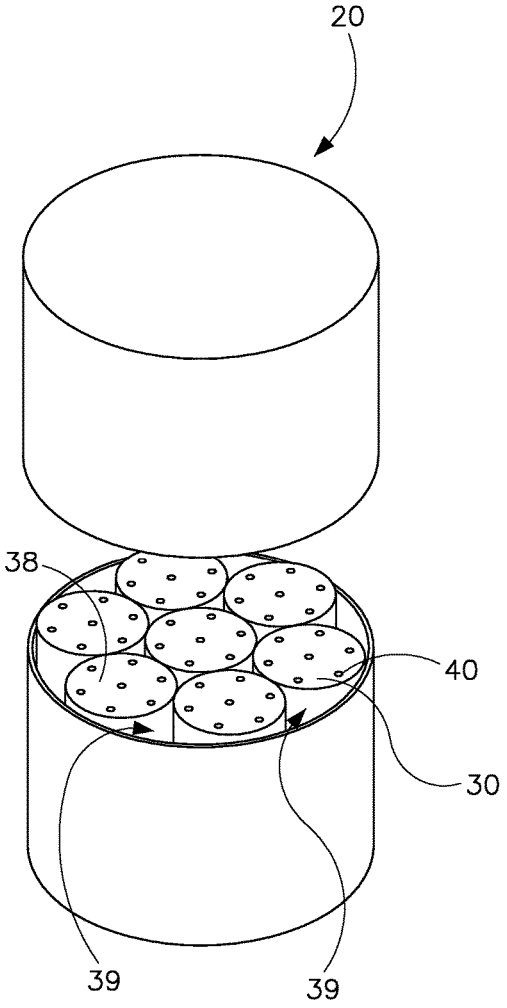
FIG. 7
FIG. 8
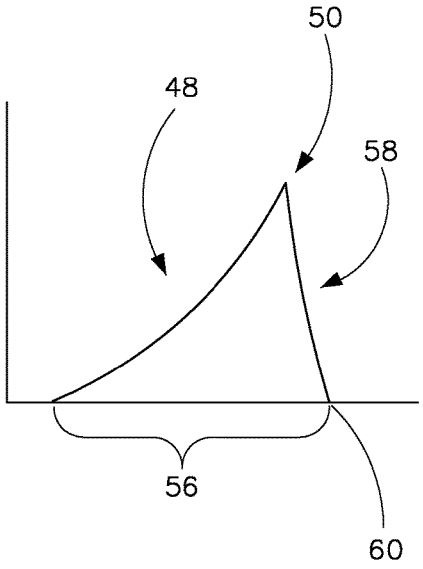

METHOD OF CREATING AND FINISHING PERFORATIONS IN A HYDROCARBON WELL

BACKGROUND

A hydrocarbon well (oil or gas) is typically finished using a device known as a perforating gun. This device includes a steel tube containing a set of devices, typically referred to as "shaped charges" each of which includes a charge of high explosive and a small amount of copper. The tube is lowered into the well, and the high explosive charges are detonated, fragmenting the copper and accelerating the resultant copper particles to a speed on the order of 30 mach, so that it blasts through the wall of the steel tube, through any steel casing forming the wall of the well, and perforates the surrounding rock, thereby permitting oil or gas or both to flow into the well.

Unfortunately, the resultant perforation has some characteristics that inhibit the flow of liquid or gas into the perforation from the surrounding rock. As the copper particles push into the rock it pushes the rock immediately in its path rearward and to the side, and also heats this rock, resulting in perforation surfaces that are less permeable to the flow of liquids and gasses than would otherwise be the case.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a method of creating and finishing perforations in a hydrocarbon well, starting by shooting a high velocity jet of metal particles into the well wall, thereby creating a perforation in the well wall. After this, a gas blast is pushed into the perforation, for a blast time duration, with the gas blast creating an increasing pressure at the perforation, until a maximum is reached, when the pressure of the gas then undergoes a period of rapid decline to a level of less than 50% of the maximum pressure. The period of rapid decline takes less than one-sixth of the blast time duration. In one preferred embodiment, the period of rapid decline takes less than one-tenth of the blast time duration. Accordingly, the time pattern of speed and pressure of the gas blast results in a higher maximum pressure at the perforation, resulting in localized fracturing, emanating from the perforation, which permits a greater flow of hydrocarbons into the perforation and from the perforation into the well.

In a second separate aspect, the present invention may take the form of a perforation creating-and-finishing assembly, for use in a well having a well wall and that includes a tube having a tube wall with shaped charges positioned within the tube and adapted to shoot a high velocity jet of metal particles through the tube wall and into the well wall. Also, the assembly includes pieces of propellant, also positioned within said tube, with each piece of propellant having surface area. Also, a detonating cord is adapted to substantially simultaneously ignite the shaped charges and the pieces of propellant, thereby causing each piece of propellant to combust over the surface area. Finally, the pieces of propellant are configured so that as they combust the surface area undergoing combustion increases over time, until the propellant is substantially consumed by the combustion and further wherein the propellant initially combusts slowly enough that the combustion of the propellant does not interfere with functioning of the shaped charges.

In a third separate aspect, the present invention may take the form of a method of perforating a well wall, which utilizes a perforation creating-and-finishing assembly, for use in a well having a well wall. The assembly includes a tube having a tube wall; shaped charges, positioned within the tube; pieces of propellant, also positioned within said tube, with each piece of propellant having surface area and being configured so as to combust at an increasing rate until substantially consumed; and a detonating cord, disposed within the tube; lowering the assembly into a well and igniting the detonating cord, thereby causing the detonating cord to ignite the shaped charges and the propellant, the shaped charges shooting a high velocity jet of metal particles through the tube wall and into the well wall, thereby creating a perforation, and the pieces of propellant combusting at an increasing rate, causing increasing pressure at the perforation, until the propellant is substantially exhausted.

In addition to the exemplary aspects and embodiments described above, further aspects and embodiments will become apparent by reference to the drawings and by study of the following detailed descriptions.

BRIEF DESCRIPTION OF THE DRAWINGS

FIG. 7 is an isometric view of a cylindrical carton filled with pieces of propellant.

FIG. 8 is a graph of combustion rate over time of the propellant in the device of FIGS. 1-3 and 5.

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENT

Figure 1:
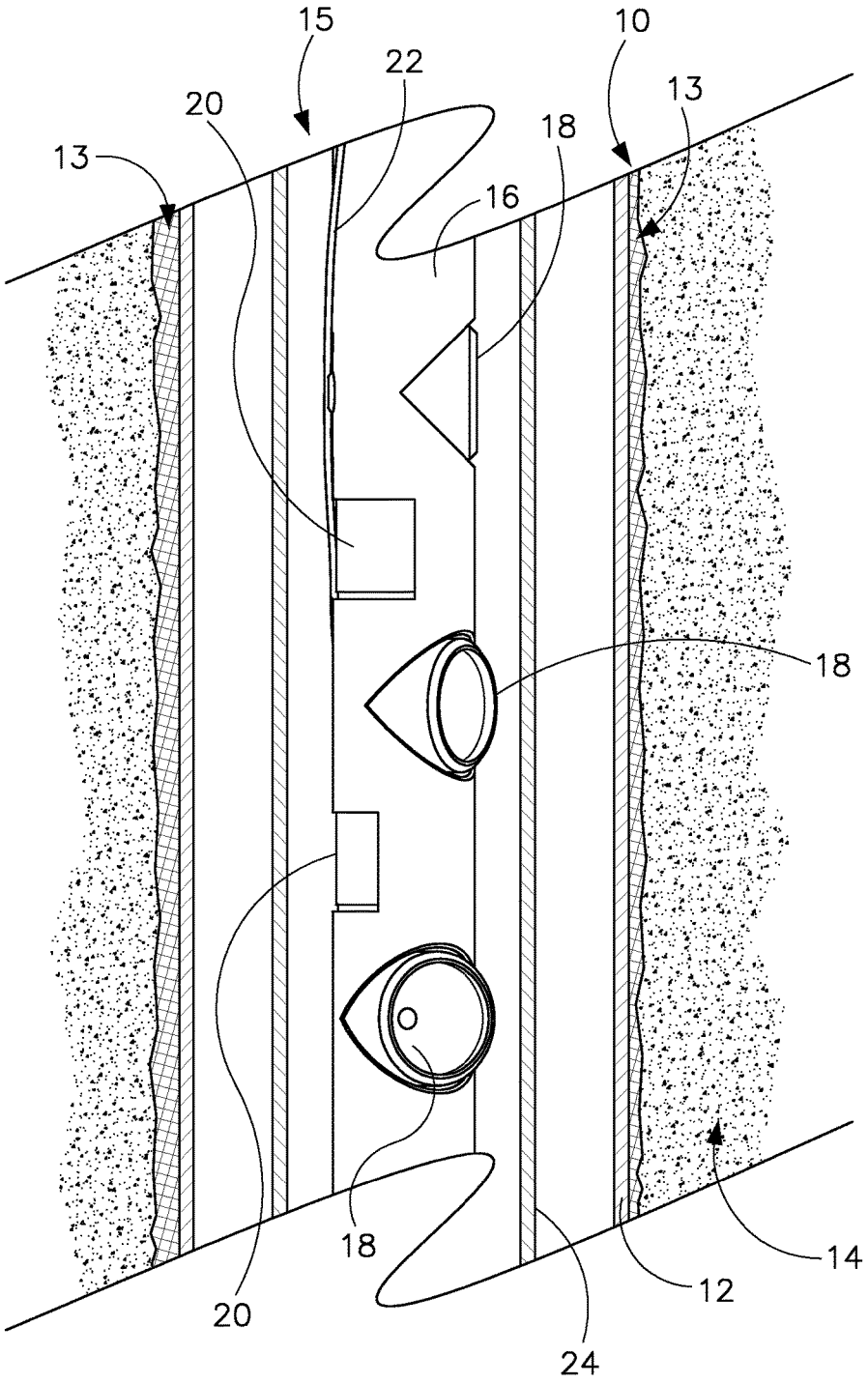
FIG. 1 is a sectional view of a portion of a hydrocarbon well having a perforation creating and finishing device, shown in a side view for ease of description.

Referring to FIG. 1, in a preferred method of creating finished perforations in the wall 10 of an oil or gas well, which is made up of steel casing 12, cement 13 and underlying rock 14, a perforating gun 15 is lowered into proximity of a portion of wall 10, to be treated. Perforating gun 15 includes a charge tube 16, which supports a number of shaped charges 18, containers 20 of propellant 38 (FIG. 7) and a detonating cord 22, all encased in a fluid-impermeable sealed steel carrier 24.

Figure 2:
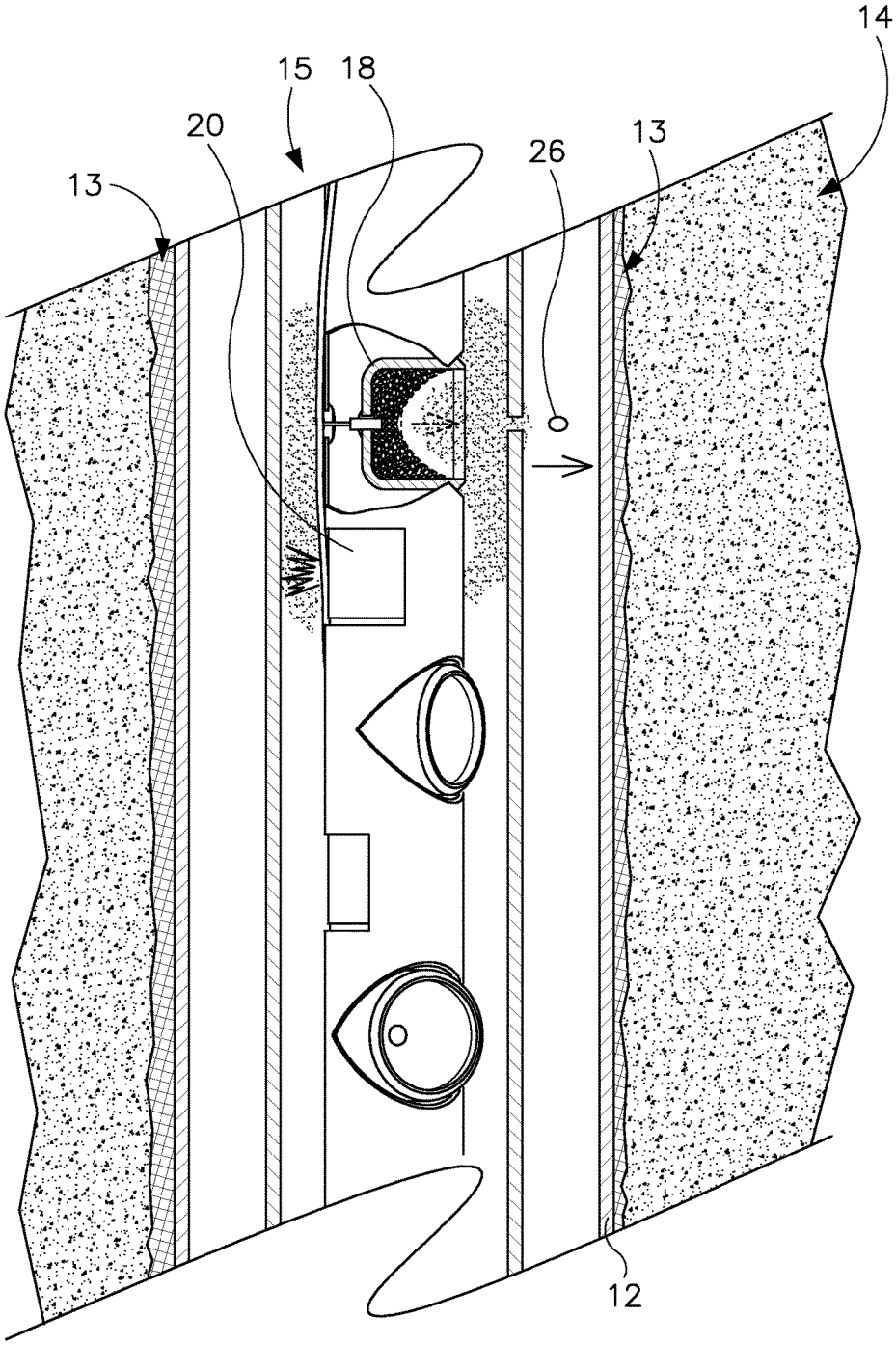
FIG. 2 shows the environment and device of FIG. 1, during detonation of the device.
Figure 3:
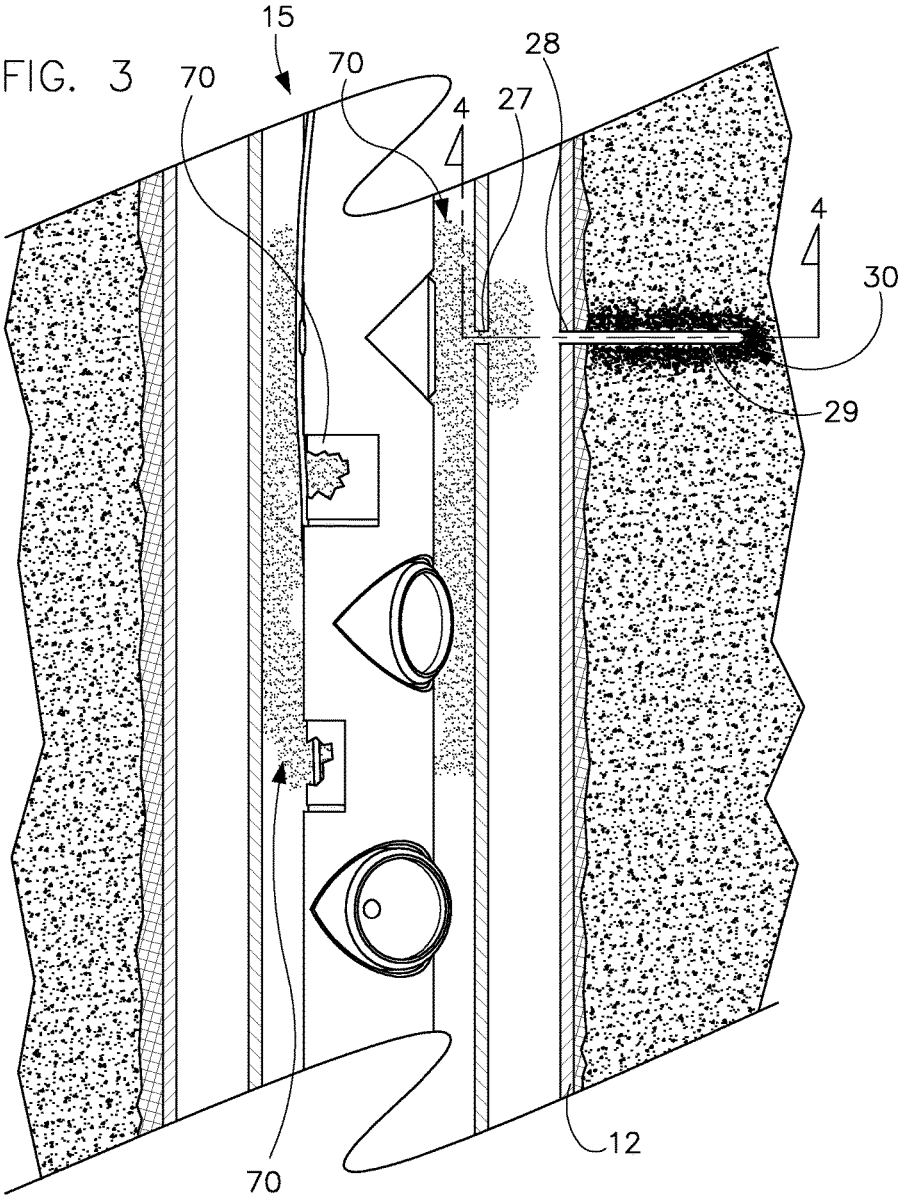
FIG. 3 shows the environment and device of FIG. 1, at a further stage of deployment, after a perforation in the well wall has been created.
Figure 4:
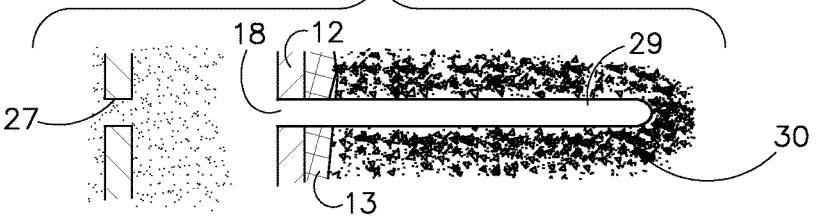
FIG. 4 is an expanded sectional detail view of the well wall perforation of FIG. 3, taken along line 4-4 of FIG. 3.
Figure 5:
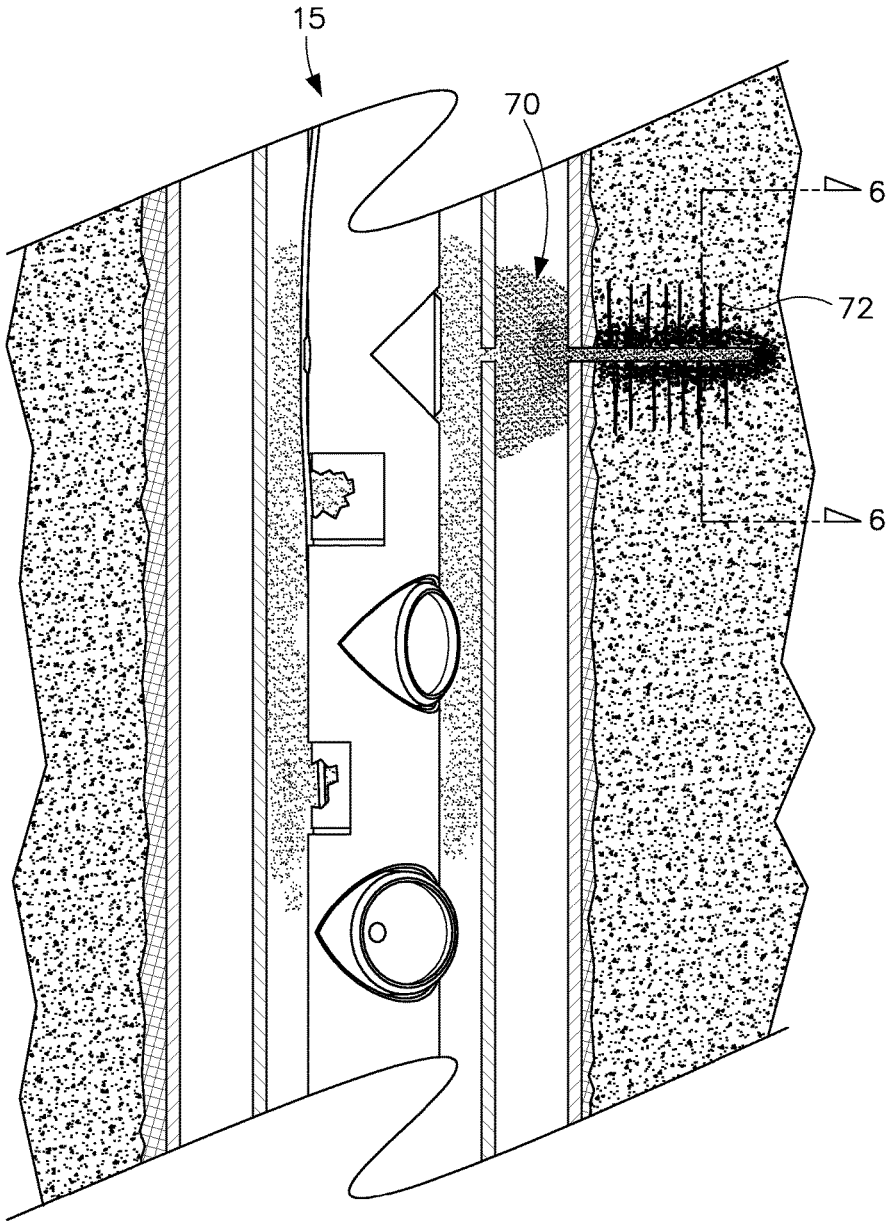
FIG. 5 shows the environment and device of FIG. 1, at a final stage of deployment, showing the finished perforation.
Figure 6:
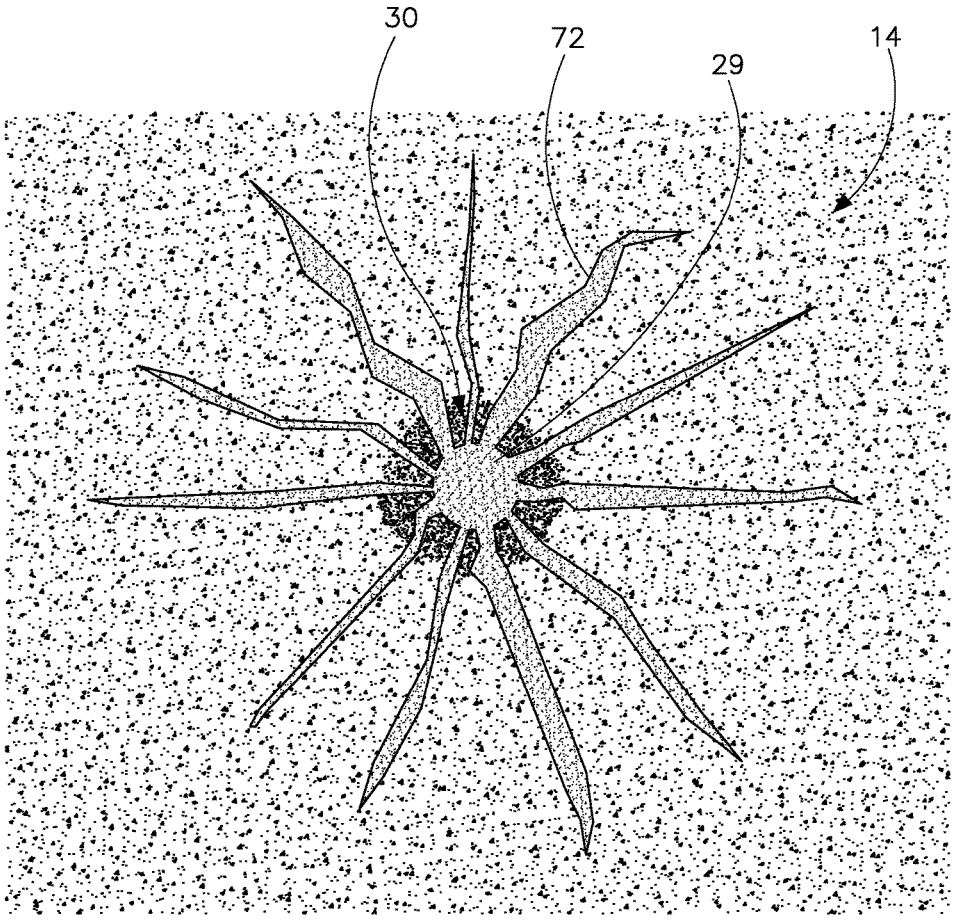
FIG. 6 is an expanded sectional detail view of the finished well wall perforation of FIG. 5, taken along line 6-6 of FIG. 5.

Referring to FIGS. 2 and 3, the detonating cord 22 is ignited, causing the shaped charges 18 to expel particles of metal 26 (FIG. 2—shown as an ellipse for ease of presentation) at a high velocity, within ten microseconds. Travelling at approximately 30 mach, the metal particles 26 penetrate through steel carrier 24, creating a carrier perforation 27 (FIG. 3) and into the wall 10, creating a perforation 28 (FIG. 3) through the steel casing 12, and a further perforation 29 (FIG. 3) in the rock 14, thereby facilitating the flow of hydrocarbons into the well.

The movement of the metal particles 26 into the rock creates a perforation 29, having walls 30, which have been seared and made more dense by rock 14 that has been pushed to the side or pushed toward the back of the perforation 29. Consequently, the perforation does not facilitate the flow of oil as much as might be possible. The containers 20 of propellant 38 combust over a period between 10 and 100 milliseconds, far more slowly than the action of the shaped charges 18. In one preferred embodiment, the rate of combustion 56 of the propellant 38 increases with greater pressure, causing said combustion rate to increase at a greater than linear rate 48 as some propellant 38 combusts and said gas thereby released creates a higher pressure; however, at least one additional piece 39 of propellant 38 may not combust at an increasing rate after being ignited. Referring to FIGS. 5, 6, 7 and 8, in a few milliseconds, the combustion has spread over the surface areas of the pieces 39 of propellant 38 (FIG. 7), including the interior surface areas, created by a set of seven through-holes 40 in each piece 39 of propellant 38. As the through-holes 40 grow in diameter, due to the combustion, the surface area of each through-hole grows, just as the outer diameter of the piece 39 of propellant 38 is reduced over time. In one preferred embodiment, the pieces 39 of propellant 38 are packed together in groups, with each group including seven pieces 39 of propellant 38, and being interposed between two shaped charges.

Referring to FIG. 8, as the propellant collectively combusts, the combustion rate 48 of propellant 38 reaches a maximum 50 (FIG. 8), directly before the fuel is exhausted, resulting in a high maximum combustion rate 50, followed by a rapid plunge 58 to zero 60. In one preferred embodiment, the rapid decline 58 takes less than one-sixth of the blast time duration. In another preferred embodiment, the rapid decline 58 takes less than one-tenth of the blast time duration. Not only does the combustion rate increase due to through-holes 40, but also because propellant 38 combusts more rapidly under higher pressure. As the combustion progresses, a gas 70 is produced, which increases the pressure inside carrier 24 (and very quickly, outside of carrier 24, as well). This increased pressure also causes propellant 38 to combust more rapidly, leading to the nonlinear combustion rate curve 48. In a preferred embodiment, the period during which the combustion rate plunges from the maximum 50 to zero 60 (the combustion cessation period), takes less than one-tenth of the total time period of combustion 56. For each piece 39 of propellant 38 the combustion cessation period is less than one-thirtieth of the period of combustion 56 (for the same piece 39 of propellant 38).

The hot gas 70, that is the product of the propellant combustion is pushed rapidly and forcefully out of the tubing perforations 26 with increasing speed that is proportional to the increasing pressure caused by the gas blast, and into well wall perforations 28 and 29, which are still fairly well aligned with carrier perforation 27, as the relatively massive perforating gun 16 accelerates and moves relatively slowly. In one preferred method, the pressure created by gas 70 increases until a maximum is reached before declining rapidly. Both the speed and the pressure of the gas 70 act to break apart the rock 14, and create a star pattern of fissures 72 emanating radially from perforation 28, thereby facilitating the flow of oil and gas into the well.

The through-holes 40 of propellant 38 result in a higher maximum combustion rate and a corresponding higher pressure at perforation 29, than would be otherwise the case. Surprisingly, because of the through-holes 40, the maximum pressure applied to the perforations 29 is high enough to be effective, even though large portions of steel carrier 24 are taken up by shaped charges 18, and thereby not available for stowage of propellant 38.

The propellant 38 includes its own oxidizer, and so does not need any external source of oxygen to combust. Further, propellant 38 may be either single-based (nitrocellulose), double-based (nitrocellulose and nitroglycerin), or triple-based (nitrocellulose, nitroglycerin, and nitroguanadine). These propellants may be available from BAE Systems, in Radford, Va.

While a number of exemplary aspects and embodiments have been discussed above, those possessed of skill in the art will recognize certain modifications, permutations, additions and sub-combinations thereof. For example one or more pieces of propellant that do not include through-holes could be included and combust at a decreasing rate, or that include a single through-hole and combust at a steady rate, could be included. It is therefore intended that the following appended claims and claims hereafter introduced are interpreted to include all such modifications, permutations, additions and sub-combinations as are within their true spirit and scope.

The invention claimed is:

1. A perforation creating-and-finishing assembly, for use in a well having a well wall, and comprising:

(a) a tube having a tube wall (b) shaped charges positioned within said tube and adapted to shoot a high velocity jet of metal particles through said tube wall and into said well wall;

(c) pieces of propellant, also positioned within said tube, with each piece of propellant having surface area; and (d) a detonating cord, adapted to substantially simultaneously ignite said shaped charges and said pieces of propellant, thereby causing each piece of propellant to combust over said surface area; and (e) wherein said pieces of propellant are configured so that as they combust said surface area undergoing combustion increases over time, until said propellant is substantially consumed by said combustion and further wherein said propellant initially combusts slowly enough that said combustion of said propellant does not interfere with functioning of said shaped charges.

2. The assembly of claim 1, wherein said pieces of propellant are packed together in groups, each group being interposed between two shaped charges.

3. The assembly of claim 1, wherein said pieces of propellant each define multiple through-holes, thereby causing said surface area of each piece to increase during combustion, as said perforations grow in diameter.

4. The assembly of claim 3, wherein said pieces of propellant each define seven through-holes.

5. The assembly of claim 1, wherein said propellant combusts over a period of greater than 10 milliseconds and less than 100 milliseconds.

6. The assembly of claim 1, further including at least one additional piece of propellant that does not combust at an increasing rate, after being ignited.

7. The assembly of claim 1, wherein the rate of combustion of said propellant increases with greater pressure, thereby causing said combustion rate to increase at a greater than linear rate, as some propellant combusts and said gas thereby released creates a higher pressure.

8. A method of perforating a well wall, comprising:

(a) providing a perforation creating-and-finishing assembly, for use in a well having a well wall, and including:
   (i) a tube having a tube wall;
   (ii) shaped charges, positioned within said tube;
   (iii) pieces of propellant, also positioned within said tube, with each piece of propellant having surface area and being configured so as to combust at an increasing rate until substantially consumed; and
   (iv) a detonating cord, disposed within said tube;

(b) lowering said assembly into a well and igniting said detonating cord, thereby causing said detonating cord to ignite said shaped charges and said propellant, said shaped charges shooting a high velocity jet of metal particles through said tube wall and into said well wall, thereby creating a perforation, and said pieces of propellant combusting at an increasing rate, causing increasing pressure at said perforation, until said propellant is substantially exhausted.

9. The method of claim 8, wherein said propellant collectively combusts, for a propellant combustion period, at a rate that increases to a maximum and then drops from said maximum to a zero rate of combustion, for a combustion cessation period, when all of said propellant has been consumed, and wherein said combustion cessation period is less than one-tenth of said propellant combustion period.

10. The method of claim 8, wherein for each piece of propellant, said propellant combusts, for a propellant combustion period, at a rate increasing to a maximum and then dropping from said maximum to a zero rate of combustion, for a combustion cessation period, when all of said propellant has been consumed, and wherein said combustion cessation period is less than one-thirtieth of said propellant combustion period.

11. The method of claim 8, wherein each piece of propellant defines through-holes which increase in diameter as combustion progresses, thereby increasing said rate of combustion.

12. The method of claim 11, wherein each piece of propellant defines seven through-holes.

13. The method of claim 8, wherein said pieces of propellant are interposed between said shaped charges.

14. The method of claim 13, wherein said pieces of propellant are packed together in groups, each group being interposed between two shaped charges.

15. The method of claim 14, wherein each group of pieces of propellant includes seven pieces of propellant.

16. The method of claim 8, further including at least one additional piece of propellant that does not combust at an increasing rate, after being ignited.

17. The method of claim 8, wherein said rate of combustion of said propellant also increases with greater pressure, thereby causing said combustion rate to increase at a greater than linear rate as propellant combusts and gas thereby released creates a higher pressure.

* * * * *